US006446461B1

(12) United States Patent
Williams, Jr.

(10) Patent No.: US 6,446,461 B1
(45) Date of Patent: Sep. 10, 2002

(54) BEVERAGE COOLER

(76) Inventor: David L. Williams, Jr., 979 Lyle Boyd Rd., Rock Hill, SC (US) 29730

( * ) Notice: Subject to any disclaimer, the term of this patent is extended or adjusted under 35 U.S.C. 154(b) by 0 days.

(21) Appl. No.: 09/789,138

(22) Filed: Feb. 20, 2001

(51) Int. Cl.[7] ..... F25D 3/08
(52) U.S. Cl. ..... 62/457.5; 220/592.16
(58) Field of Search ..... 62/457.4, 457.5; 141/325; 220/592.16, 592.17

(56) References Cited

U.S. PATENT DOCUMENTS

| | | | | | |
|---|---|---|---|---|---|
| 56,978 | A | * | 8/1866 | Miller | 62/457.5 |
| 1,681,110 | A | * | 8/1928 | Friedman | 62/457.5 |
| 3,302,427 | A | | 2/1967 | Stoner et al. | |
| 4,266,407 | A | | 5/1981 | Gibson | |
| 4,295,345 | A | | 10/1981 | Atkinson | |
| D270,985 | S | | 10/1983 | Hill | |
| 4,441,336 | A | | 4/1984 | Cannon | |
| 4,554,798 | A | * | 11/1985 | D'Amour | 62/457.5 |
| 4,620,426 | A | | 11/1986 | Pitchford et al. | |
| D292,057 | S | | 9/1987 | Beal | |
| D293,642 | S | | 1/1988 | Rubbright, III et al. | |
| D295,596 | S | | 5/1988 | Schaffer | |
| 4,747,274 | A | | 5/1988 | Duemmig-Zitzmann | |
| 4,768,354 | A | | 9/1988 | Barnwell | |
| 5,007,250 | A | | 4/1991 | Musielak | |
| D345,897 | S | | 4/1994 | Vitez | |
| D354,420 | S | | 1/1995 | Sharp | |
| D358,966 | S | | 6/1995 | Ochs | |
| D393,778 | S | | 4/1998 | Ochs, Sr. | |
| D395,202 | S | | 6/1998 | Ochs, Sr. | |
| 5,758,513 | A | | 6/1998 | Smith | |
| 5,806,338 | A | | 9/1998 | Schwartz et al. | |
| 5,901,571 | A | * | 5/1999 | Whaley | 62/457.5 |
| 6,067,813 | A | | 5/2000 | Smith | |

* cited by examiner

*Primary Examiner*—William E. Tapolcal
(74) *Attorney, Agent, or Firm*—Summa & Allen, P.A.

(57) ABSTRACT

A cooler is disclosed that utilizes beverage compartments that are integral to the container holding the refrigerant. The beverage compartments are such that they are completely encircled by yet physically separated from the refrigerant. The design provides easy access to the beverage, close contact between the beverage and refrigerant, and the elimination beverages buried in melting ice.

24 Claims, 2 Drawing Sheets

BEVERAGE COOLER

FIELD OF THE INVENTION

The present invention pertains to transportation and temperature regulation of consumables. In particular, the present invention pertains to the transportation and temperature regulation of packaged fluids, such as soft drinks.

BACKGROUND OF THE INVENTION

Insulated coolers for transporting canned drinks and food are a fixture of American culture and are practically required equipment for picnics, sporting events and other outdoor activities. Insulated coolers are also utilized in industrial applications. For example, coolers are used to transport medical supplies and samples for scientific analysis, such as soil samples for environmental testing.

The myriad of potential uses for coolers fueled an almost endless variation in their design. Coolers act as armrests in vehicles. Coolers are designed to wrap around the torso like a hiker's "fanny pack". There are very large coolers and very small coolers. The majority of these coolers, however, all share one thing in common: they contain a cavity, usually rectangular, that holds both the material to be cooled (i.e., can drinks) and the refrigerant (i.e., ice or a frozen insert). These coolers also share the common design feature of some type of lid that completely encloses the material to be cooled and the refrigerant. The lid is intended to extend to life of the refrigerant by reducing heat transfer between the ambient temperature and the refrigerant.

Unfortunately, the lid, along with the body of the cooler, hides the contents of the cooler. This limitation of known coolers is often bothersome when coolers are used at sporting events or other areas with entrance restrictions. For example, many sporting events will allow spectators to carry coolers with soft drinks but not alcoholic beverages. Enclosed coolers are therefore often the subject of a time consuming search by security personnel.

Additionally, the ice that is usually the refrigerant of choice for most coolers eventually melts resulting in cold wet hands or wet food. If frozen inserts are used instead of ice, care must be taken to ensure that the contents of the cooler remain in contact with the inserts otherwise insufficient cooling will take place.

Accordingly, a need exists for a cooler that does not possess the limitations stated above. In particular, a need exists for a cooler that allows its contents to be visible at all times, if desired. Additionally, this cooler should provide close contact between the material to be cooled and the refrigerant while avoiding the problems associated with close contact refrigerants such as crushed ice.

OBJECT AND SUMMARY OF THE INVENTION

Therefore, an object of the present invention is to provide a cooler that effectively maintains a desired temperature for articles transported therein while avoiding the problems associated with known coolers, namely the concealment of the articles.

A further object of the invention is to provide a cooler that maintains close contact between the material to be cooled and the refrigerant.

These and other objects and advantages of the present invention are provided by a unique cooler for carrying packaged beverages. In one embodiment, the cooler comprises a hollow polygon having at least six faces, an enclosed interior, and an opening in at least one face of the hollow polygon. The opening provides fluid communication with the interior of the hollow polygon. In other words, the opening (i.e., drain/fill cap) allows the hollow polygon to be filled with a liquid and subsequently drained. The cooler also comprises at least one cavity extending from one of the polygon's faces into the interior of the polygon. The cavity is not in fluid communication with the interior of the polygon or the above mentioned opening. For example, water poured into the cavity will not enter the interior of the polygon and flow out the opening and water entering the opening will not flow into the cavity. In many applications, the cavity will be of a size and shape to receive a standard drink can.

DETAILED DESCRIPTION

Figure 1:
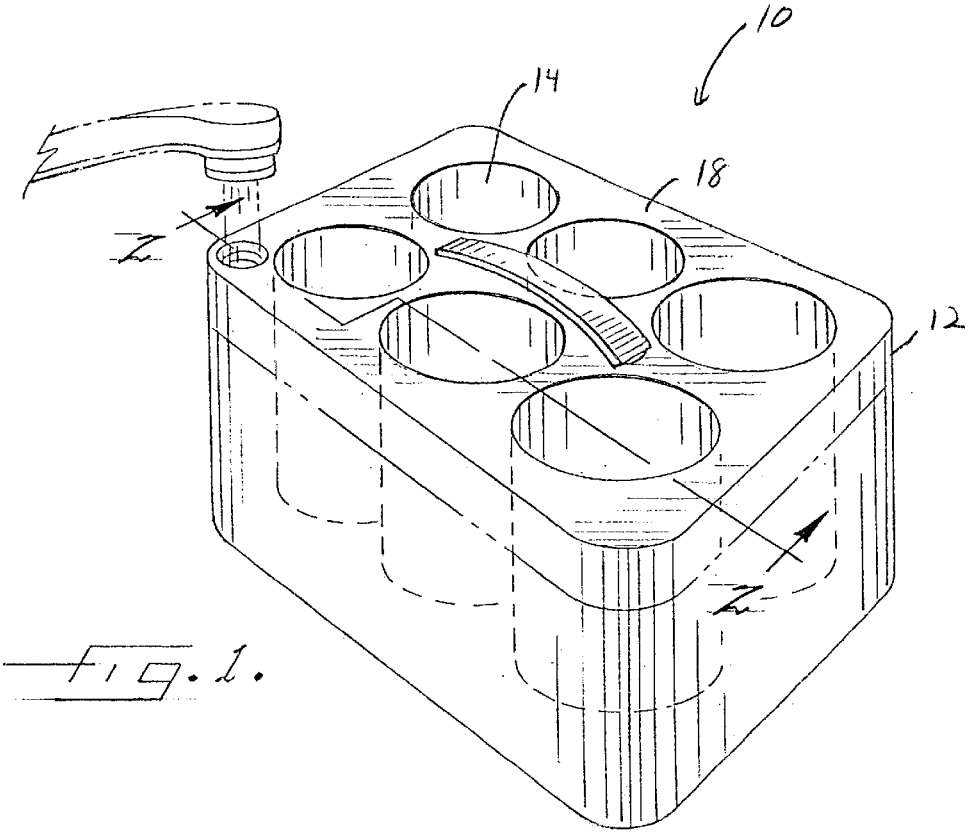
FIG. 1 is a perspective view of one embodiment of the cooler according to the invention.

The invention provides a cooler for transporting articles while maintaining those articles at a desired temperature. In particular and referring now to FIGS. 1 and 2, the invention provides a cooler 10 for carrying packaged beverages, for example, soft drink cans. The embodiment of the invention shown in FIG. 1 comprises a hollow polygon 12, preferably having at least six faces. It will be understood that solid polygons can comprise as few as four faces (e.g., tetrahedral and pyramids) and coolers according to the invention can include such shapes. The invention also includes other hollow geometrical shapes such as hollow spheres, ovals (e.g., egg shaped) etc, that may not fit the precise definition of a polygon. Such shapes may possess one, two, or three surfaces or faces. Nevertheless, the term polygon as used herein should be interpreted to include such geometrical shapes. The rectangular polygon illustrated in the drawings, however, is presently preferred for a number of reasons.

Figure 4:
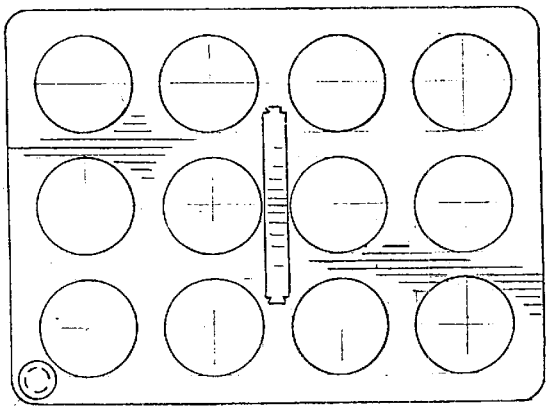
FIG. 4 is a schematic of a cooler according to the invention that holds twelve drink cans.

The hollow polygon 12 acts as a container for a temperature controlling substance 13; the easiest and most convenient of which is ice. In a preferred embodiment, the hollow polygon 12 is formed of a polymer or polymer composite, is generally rectangular and is of a length and width sufficient to encompass the space needed to enclose at least six beverage cans. As used herein, the term polymer includes composites comprising polymers. It is to be understood, however, that the size and shape of the hollow polygon 12 may vary depending upon the requirements of the user. For example, FIG. 4 illustrates an embodiment of the invention that holds twelve cans.

Likewise, the polymer employed in the practice of the invention may be any polymer utilized in production of coolers or molded articles. Polymers such as polyethylene, polypropylene, and polyethylene terephthalate and composites thereof are representative candidates.

Figure 2:
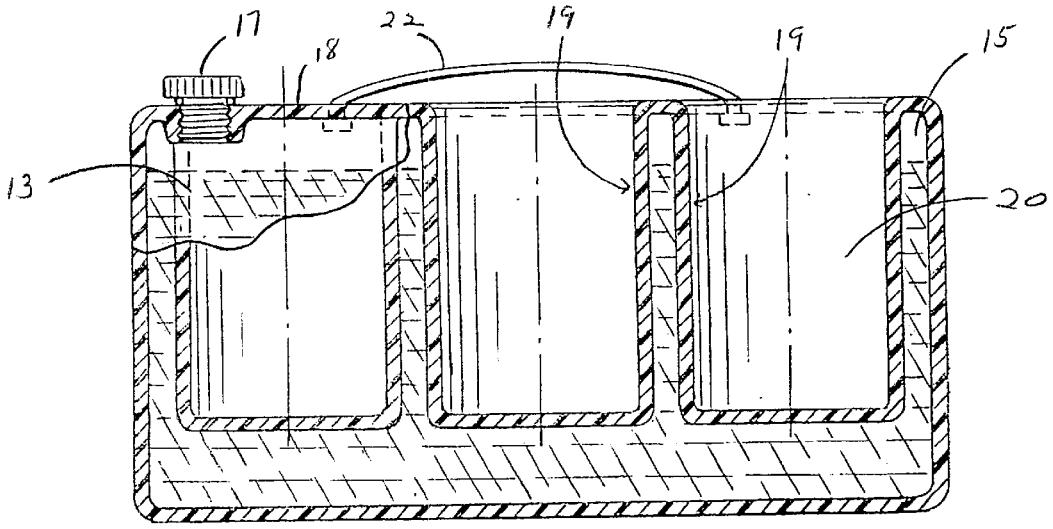
FIG. 2 is a cross-section of the cooler of FIG. 1 taken along line 2—2 of FIG. 1.

The cooler according to the invention also comprises an opening 14 in at least one face of the hollow polygon 12 that provides fluid communication with the interior 15 of the hollow polygon 12. The purpose of the opening 14 is to provide a means to fill and drain the hollow polygon 12 with a temperature controlling substance. The functional aspect of the opening 14 is illustrated in FIG. 1 where a common water faucet can be used to fill the interior 15 of the polygon with water. The opening 14 is closed by a simple screw cap 17 as shown in FIG. 2 or any other suitable means for controlling fluid flow. In the embodiment shown in FIGS. 1 and 2, the opening 14 is located on the upper or top face 18 of the hollow rectangular polygon 12. Although this is a convenient location for the opening 14, the opening or additional openings may be located at any point on the surface of the hollow polygon 12. A fill level 16 along the outer perimeter of the hollow polygon 10 indicates an appropriate quantity of temperature controlling substance to use.

In most instances the temperature controlling substance 13 will be a coolant such as cold water or ice or a liquid or gel refrigerant such as those currently used in reuseable cold packs. The invention, however, also contemplates the use of high temperature substances such as hot water or oil, provided that the hollow polygon 12 is made of a material resistant to high temperatures. Thus, it will be understood that the term "cooler" is used in an exemplary rather than limiting fashion.

In an alternative embodiment, the cooler according to the invention need not possess an opening 14 that provides fluid communication with the interior 15 of the hollow polygon 12. In this embodiment, the temperature controlling substance, most likely a non-water or gel refrigerant, is sealed inside the interior 15 of the hollow polygon, thus eliminating filling and emptying the interior 15 on a periodic basis.

Referring now to FIG. 2, the apparatus according to the invention is further defined by at least one cavity 20 that extends from one of the polygon faces 18 into the hollow polygon 12 but is not in fluid communication with the opening 14 (or the interior 15 of the hollow polygon 12). The cavity 20 is integral to the hollow polygon 12 (e.g., a molded article). In other words, the walls 19 of the cavity 20 also function as the outer surface of the hollow polygon 12. In the embodiments shown in FIGS. 1 and 2, the hollow polygon 12 possesses a plurality of cavities 20 that are cylindrical and have a circumference sufficient to receive a standard drink can. Preferably, the cavity 20 extends inwardly to a depth that is less than the height of a standard drink can. This depth allows a portion of the can to extend out of the cooler to facilitate a quick and easy inspection of the cooler's contents. Furthermore, the cavities are separate and apart from one another thereby allowing the temperature controlling substance to substantially surround the perimeter of the cavity 20.

It will be understood that the phrase "standard drink can" is used in an exemplary rather than limiting sense, and that the cooler 10 can be formed to accommodate cans of different sizes as may be desirable or necessary. If desired, the cavities 20 can differ in size from one another to allow differently sized containers to be carried at the same time.

A handle 22 may be attached to the hollow polygon 12. In the embodiment shown in FIG. 1, the handle is attached to the top face 18 of the hollow polygon but may be attached to other faces (or to two faces) as well.

Figure 3:
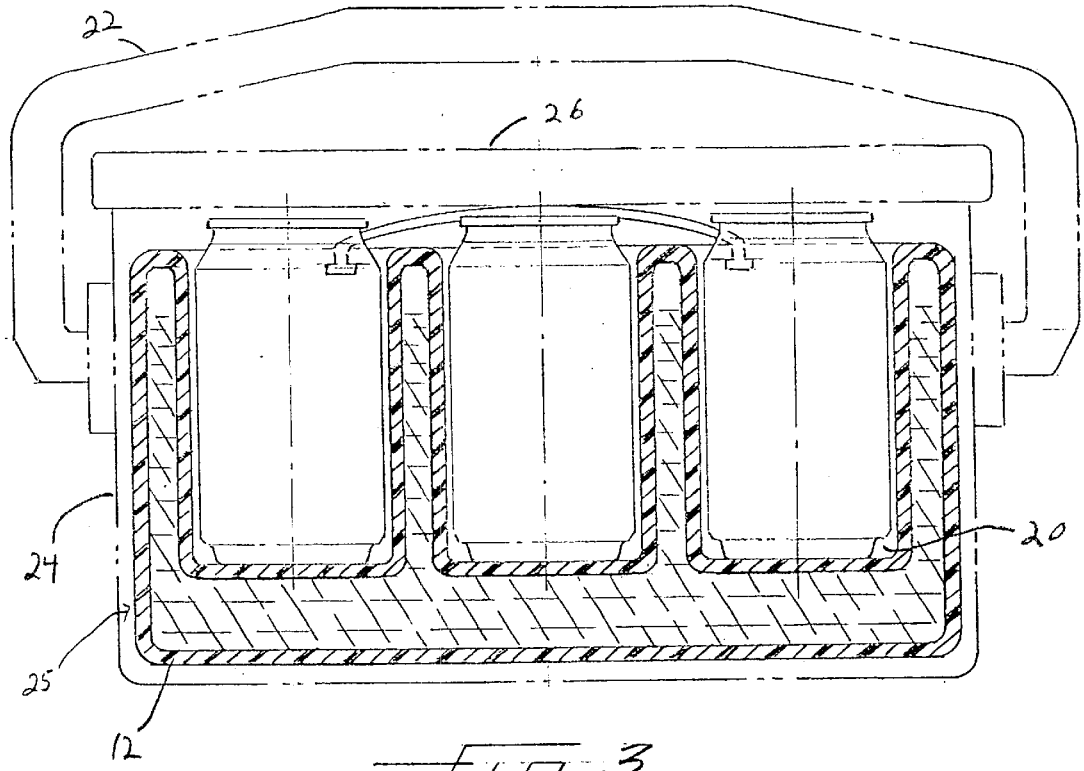
FIG. 3 is a cross-section of the cooler of FIG. 1 in conjunction with a mating receptacle.

Referring now to FIG. 3, another embodiment of the invention is a cooler insert that may be used in conjunction with a traditional cooler. In this embodiment, the invention comprises a hollow polygon 12 having an opening 14 and cavities 20 such as that previously described. As discussed in previous embodiments, the hollow polygon 12 need not possess an opening 14 if the refrigerant is sealed in the polygon 12. This embodiment also comprises a receptacle 24 having an interior space 25 of substantially the same shape and area as the polygon 12 and sized to receive the polygon 12 in a close mating relationship as shown in FIG. 3. In certain circumstances the use of a receptacle 24 may be desired. For example, if the hollow polygon 12 is filled with water which is then frozen, the outer surface of the hollow polygon 12 may "sweat" on hot days causing anything placed against the hollow polygon 12 to become damp. Placing the hollow polygon 12 in a receptacle would help contain the sweat. Furthermore, insulating the receptacle 24 would extend the cooling capacity of the cooler.

Finally, a handle 22 and a lid 26 may be incorporated into the design of the receptacle 24. The lid 26, when closed, substantially encloses the hollow polygon 12. Thus, the apparatus according to the invention may operate as an insert to a traditional cooler (i.e., the receptacle 24 and lid 26).

The invention has been described in detail, with reference to certain preferred embodiments, in order to enable the reader to practice the invention without undue experimentation. However, a person having ordinary skill in the art will readily recognize that many of the components and parameters may be varied or modified to a certain extent without departing from the scope and spirit of the invention. Furthermore, titles, headings, or the like are provided to enhance the reader's comprehension of this document, and should not be read as limiting the scope of the present invention. Accordingly, only the following claims and reasonable extensions and equivalents define the intellectual property rights to the invention.

That which is claimed is:

1. A cooler for carrying packaged beverages comprising:

a hollow solid polygon defined by at least one face;

an opening in at least one face of said hollow polygon for providing fluid communication into said hollow polygon; and at least one cavity extending from at least one face to a point within the interior of said hollow polygon, wherein said cavity is not in fluid communication with said opening in said polygon, and wherein said cavity forms a portion of the outer surface of said hollow polygon.

2. The cooler of claim 1 wherein said polygon has six faces.

3. The cooler of claim 1 wherein said polygon is formed of a polymer.

4. The cooler of claim 3 wherein said polygon is filled with a material selected from the group consisting of water, ice, and an organic based liquid or gel coolant.

5. The cooler of claim 3 wherein said polygon comprises a plurality of said cavities.

6. The cooler of claim 5 wherein said cavities are cylindrical.

7. The cooler of claim 6 wherein said cavities possess a circumference sufficient to receive a standard drink can and extend inwardly to a depth that is less than the height of a standard drink can.

8. The cooler of claim 7 further comprising a handle attached to at least one face of said polygon housing said cavity.

9. The cooler of claim 1 further comprising a receptacle having an interior space of substantially the same shape and area as said polygon and sized to receive said polygon in a close mating relationship.

10. The cooler of claim 9 wherein said receptacle comprises a lid which when closed encloses said polygon.

11. The cooler of claim 10 further comprising a handle attached to said receptacle.

12. A cooler for carrying packaged beverages comprising:

a hollow polygon defined by an enclosed interior and at least one face;

at least one cavity extending from at least one face to a point within said interior of said hollow polygon wherein said cavity is not in fluid communication with said interior of said hollow polygon and wherein said cavity forms a portion of the outer surface of said hollow polygon; and a temperature controlling substance retained in said interior of said polygon that substantially surrounds the perimeter of said cavity.

13. The cooler of claim 12 wherein said hollow polygon is formed of a polymer.

14. The cooler of claim 13 wherein said polygon comprises a plurality of said cavities.

15. The cooler of claim 14 wherein said cavities are cylindrical.

16. The cooler of claim 15 wherein said temperature controlling substance is a material selected from the group consisting of water, ice, non-water liquids and non-water gels.

17. The cooler of claim 15 wherein said cavities possess a circumference sufficient to receive a standard drink can and extend inwardly to a depth that is less than the height of a standard drink can.

18. The cooler of claim 17 further comprising a handle attached to at least one face of said polygon housing said cavity.

19. The cooler of claim 12 further comprising a receptacle having an interior space of substantially the same shape and area as said polygon and sized to receive said polygon in a close mating relationship.

20. The cooler of claim 19 wherein said receptacle comprises a lid which when closed substantially encloses said polygon within said receptacle.

21. The cooler of claim 20 further comprising a handle attached to said receptacle.

22. A cooler for carrying packaged beverages comprising:

a hollow rectangular container having at least six faces;

an opening providing fluid communication with the interior of the container to permit the flow of water into and out of the container;

integral open cylinders extending from one face of said container to a point within the interior of said container, wherein said cylinders are not in fluid communication with said opening in said container and wherein said cylinder forms a portion of the outer surface of said hollow polygon; and a handle attached to said container.

23. The cooler of claim 22 further comprising a receptacle having an interior space of substantially the same shape and area as said container and sized to receive said container in a close mating relationship.

24. The cooler of claim 22 wherein said container is formed from a polymer.

* * * * *